US008439001B2

(12) United States Patent
Lapan et al.

(10) Patent No.: US 8,439,001 B2
(45) Date of Patent: May 14, 2013

(54) ACTUATOR POWERED BY FLUID AND METHOD OF FORMING THE SAME

(76) Inventors: Svetlana Lapan, Northbrook, IL (US); Yefim Epshetsky, Schaumburg, IL (US)

( * ) Notice: Subject to any disclaimer, the term of this patent is extended or adjusted under 35 U.S.C. 154(b) by 631 days.

(21) Appl. No.: 12/592,040

(22) Filed: Nov. 18, 2009

(65) Prior Publication Data

US 2011/0114053 A1 May 19, 2011

(51) Int. Cl.
*F01C 1/07* (2006.01)

(52) U.S. Cl.
USPC ..... 123/18 R; 123/193.6; 123/78 A; 123/78 AA; 123/78 B; 92/69 A; 92/69 B; 92/69 R; 92/75; 92/89; 92/140; 92/255

(58) Field of Classification Search ..... 123/193.6, 123/78 A, 78 AA; 92/69 A, 69 B, 69 R, 75, 92/89, 140, 255
See application file for complete search history.

(56) References Cited

U.S. PATENT DOCUMENTS

| | | | | |
|---|---|---|---|---|
| 5,144,923 | A * | 9/1992 | Leites et al. | 123/193.6 |
| 5,145,338 | A * | 9/1992 | Murray | 417/480 |
| 5,419,292 | A * | 5/1995 | Antonov | 123/241 |
| 6,474,288 | B1 * | 11/2002 | Blom | 123/197.2 |
| 7,392,768 | B2 * | 7/2008 | Dick et al. | 123/18 R |
| 7,404,381 | B2 * | 7/2008 | Dick et al. | 123/18 R |
| 7,707,975 | B2 * | 5/2010 | Dick et al. | 123/18 R |

* cited by examiner

*Primary Examiner* — Marguerite McMahon
*Assistant Examiner* — James Kim
(74) *Attorney, Agent, or Firm* — Inventa Capital PLC

(57) ABSTRACT

A system for moving fluids includes a pump device having a housing and at least one piston movable in the housing to displace fluids thereby causing flow. An actuator device is connected to the at least one piston for moving the piston within the housing to displace fluids as the actuator device is moved. The actuator device includes a plurality of side portions connected to one another to form a vacuum therein and movable relative to one another as the actuator device moves reciprocally between first and second positions with one of the side portions being connected to at least one piston thereby moving the at least one piston within the housing.

9 Claims, 6 Drawing Sheets

ACTUATOR POWERED BY FLUID AND METHOD OF FORMING THE SAME

FIELD OF THE INVENTION

The present invention relates to fluid powered systems and in particular to reciprocating actuators and methods of making the same.

BACKGROUND OF THE INVENTION

Internal combustion engine (ICE) is known in the art. Typical ICE is an engine in which the burning of fuel occurs in a confined space called a combustion chamber. This exothermic reaction of fuel with an oxidizer creates gases of high temperature and pressure, which are permitted to expand. The defining feature of an internal combustion engine is that useful work is performed by the expanding hot gases acting directly to cause movement, for example by acting on pistons, rotors, or even by pressing on and moving the entire engine itself. This contrasts with external combustion engines, such as steam engines, which use the combustion process to heat a separate working fluid, typically water or steam, which then in turn does work, for example by pressing on a steam actuated piston.

While such ICE provides torque and power, it does not operate very efficiently. Pistons, contained and movable in the ICE housing, cause frictional losses to occur, which undesirably reduce the amount of power or torque, which is provided by the ICE thereby increasing the overall consumption of fuel by the ICE. Frictional mode of the ICE tends to increase at a rate greater than the square of engine operation speed, such that friction losses increase by more than fourfold with a doubling of engine speed.

The ICE are mostly used in passenger automobiles, outboard engines for motor boats, small units for lawn mowers, and other such equipment, as well as diesel engines used in trucks, tractors, earth-moving, and similar equipment. Characteristic features common to all ICE include (1) the compression of air, (2) the raising of air temperature by the combustion of fuel in this air at its elevated pressure, (3) the extraction of work from the heated air by expansion to the initial pressure, and (4) exhaust.

To the extent effective, there are numerous disadvantages associated with the ICE. One of the disadvantages is the pollution that the ICE puts out. Another disadvantage is size of the ICE. Still another disadvantage of the ICE is waste of energy generated by thereby due to conventional four step process beginning from intake wherein combustible mixtures are emplaced in the combustion chamber followed by compression wherein the combustible mixtures are placed under pressure followed by combustion/expansion mode wherein the mixture is burnt and the hot mixture is expanded, pressing on and moving parts of the ICE, i.e. pistons cooperable with the crankshaft thereby moving the crankshaft, ending with exhaust mode wherein cooled combustion products are exhausted into the atmosphere.

One of the alternatives to the ICE is electric motors. Unfortunately, the electric engines are limited to predetermined distances due to non-availability of the infrastructure able to power the electric engines.

Numerous prior art patents disclose various designs of internal combustion engines and various components associated therewith. One of these prior art patents, namely U.S. Pat. No. 6,782,800 to Strain teaches a fluid powered linkage of the engine having side plates connected to form a polygon of variable cross sectional area. Several ports allow fluid to enter into or leave from the enclosed variable cross sectional area. A linkage device is used in an apparatus for producing a fluid output with altered pressure, volume or flow compared to a fluid input and a hydraulic motor. In many hydraulic or pneumatic systems, a master cylinder or pump is fluidly connected to a slave cylinder to transmit force or work to a remote location. When master and slave cylinders of unequal diameters are used, the force applied by the slave cylinder may be more or less than the force applied to the master cylinder. Similarly, the displacement of the slave cylinder may be more or less than the displacement of the master cylinder.

In these systems, however, there is always a linear relationship between the force or displacement of the slave cylinder and the force or displacement of the master cylinder. Similarly, when a pump is used to drive a slave cylinder, the force exerted by the slave cylinder is always linearly related to the pressure produced by the pump. To achieve any other relationship requires additional mechanical linkages at one end. Similarly, the design of hydraulic or pneumatic engines using cylindrical linkages is limited by such linear relationships.

There has, therefore, been a longstanding need to improve methods and systems of various applications that utilized in generation of circular movement thereby utilizing pistons reciprocally movable relative one another to generate this circular motion.

These and other problems have been solved by the improved system and method described below.

SUMMARY OF THE INVENTION

The concept of the present invention has numerous industrial applications ranging from industrial pumps for circulating fluid to internal combustion engines. The current concept is also used in as actuator in artificial heart as mechanism for circulating human fluids, such as blood through blood vessel system of a human body. If utilized as the actuator for the artificial heart, the present concept may also be used as replacement of damaged or failing heart in animal.

Below are illustrations of several industrial applications without limiting the scope of the present invention. The mechanical and conceptual principals associated with the architecture and functional aspects of the present invention are applicable in numerous other industrial applications not illustrated herewith and without limiting the aspects of the present invention.

One of the applications presents a pump system for moving fluids. Those skilled in the art will appreciate that term "fluid" includes and is not limited to water, gas, oil, and other fluids. The pump system includes a pump device having a housing and at least one piston movable in the housing to displace fluids thereby causing flow.

An actuator device is connected to the piston for moving the piston within the housing to displace fluids as the actuator device is moved reciprocally between a first position and a second position. The actuator device includes a plurality of side portions connected to one another to form a vacuum therein and movable relative to one another as the actuator device moves reciprocally between the first position and the second position.

One of the side portions is connected to the piston. The actuator device having another of the side portions being permanently secured to a surface as the actuator device is in motion. These two side portions extend in parallel and linearly plane relative to one another and are movable from an engaging position as the side portions abut one another to a disengaging position as the side portions move away from one another thereby maintaining the aforementioned parallel and linear plane between the side portions as the actuator device moves the piston within the housing. The actuator device includes four of the side portions.

One of the side portion includes an inlet port for receiving fluid to create pressure inside the vacuum thereby expanding the side portions as the side portions move from the engaging position to the disengaging position and an outlet port for releasing fluid as the side portions collapse to the engaging position thereby moving the piston movable in said housing to displace fluids for causing flow. The side portions are interconnected to one another by hinges thereby extending between the engaging and disengaging positions. Two of the side portions include a pair of cavities defined therein to receive the hinges as the side portions are in the engaging position to completely release fluid beyond the side portions.

A pair of plates sandwich the side portions therebetween thereby creating vacuum inside the side portions as the side portions move between the engaging and disengaging positions within the plates. The plates and the side portions may be fabricated from polymeric material, non-polymeric material, and the like.

Another application of the present invention is in the internal combustion engine. The inventive concept replaces and substantially improves current engine design thereby introducing novel and effective method of utilizing entire amount of energy and translating the energy into rotation force thereby increasing rotational speed of a crankshaft. An engine system of the present invention includes a housing of the engine, a plurality of pistons disposed in the housing and reciprocally movable relative to one another to generate a reciprocating motion.

The aforementioned crankshaft is disposed in the housing and presenting a central axis. The crankshaft is connected to the plurality of pistons thereby converting the reciprocating motion of the pistons into a rotational motion of the crankshaft. Each of the pistons presents a plurality of side portions connected to one another to form a vacuum therein and movable relative to one another as each of the pistons is moved reciprocally between first and second positions. One of the side portions is connected to the crankshaft. One of the side portions is permanently secured to the housing and extends in parallel and linearly plane relative to the side portion connected to the crankshaft and movable from an engaging position as the side portions abut one another to a disengaging position as the side portions move away from one another thereby maintaining the parallel and linear plane between the side portions as the crankshaft rotates about the central axis.

Each piston includes four of the side portions. One of the side portions is secured to the housing and presents an inlet port for receiving fluid to create pressure inside the vacuum thereby expanding the side portions as the side portions move from the engaging position to the disengaging position. An outlet port is defined adjacent the inlet port. The outlet port is used for releasing fluid as the side portions collapse to the engaging position thereby rotating the crankshaft about the central axis.

One of the side portion includes an inlet port for receiving fluid to create pressure inside the vacuum thereby expanding the side portions as the side portions move from the engaging position to the disengaging position and an outlet port for releasing fluid as the side portions collapse to the engaging position thereby moving the piston movable in said housing to displace fluids for causing flow. The side portions are interconnected to one another by hinges thereby extending between the engaging and disengaging positions. Two of the side portions include a pair of cavities defined therein to receive the hinges as the side portions are in the engaging position to completely release fluid beyond the side portions.

A pair of plates sandwich the side portions thereby creating vacuum inside the side portions as the side portions move between the engaging and disengaging positions within the plates. The plates and the side portions may be fabricated from polymeric material, non-polymeric material, and the like.

Still another application of the present invention is a pump system that can be utilized in any household application. The pump system includes a housing adaptable to receive fluids and release fluids therefrom. One of the examples of such application is pumping of water from reservoir into a bucket to transport the water for further use in the household. The housing presenting a plurality of side portions connected to one another to form a vacuum therein and movable relative to one another. A lever device is connected to one of the side portions. The lever device presents at least one pivoting point to rotate the lever device relative the housing.

The housing has at least two of the side portions extending in parallel and linearly plane relative to one another and movable from an engaging position as the side portions abut one another to a disengaging position as the side portions move away from one another thereby maintaining the parallel and linear plane between the side portions as fluid enters the housing from a remote reservoir and then back to the engaging position as fluid is moved beyond and out of the housing thereby circulating fluid through the housing.

The housing includes four of said side portions with one of the side portions presenting an inlet port for receiving fluid introduced into the housing and an outlet port for releasing fluid as the side portions collapse to the engaging position thereby circulating fluid through the housing. One of the side portion includes an inlet port for receiving fluid to create pressure inside the vacuum thereby expanding the side portions as the side portions move from the engaging position to the disengaging position and an outlet port for releasing fluid as the side portions collapse to the engaging position thereby moving the piston movable in said housing to displace fluids for causing flow.

The side portions are interconnected to one another by hinges thereby extending between the engaging and disengaging positions. Two of the side portions include a pair of cavities defined therein to receive the hinges as the side portions are in the engaging position to completely release fluid beyond the side portions. A pair of plates sandwich the side portions thereby creating vacuum inside the side portions as the side portions move between the engaging and disengaging positions within the plates. The plates and the side portions may be fabricated from polymeric material, non-polymeric material, and the like.

An advantage of the present invention is to provide an improved system and method for piston design adaptable for reciprocable movement that reduces entire size of the engine.

Another advantage of the present invention is to provide an improved system and method for manufacturing the engine, such as the ICE wherein the number of components is reduced thereby reducing the overall weight of the ICE.

Still another advantage of the present invention is to provide an improved system and method for manufacturing the ICE wherein the operational principals of the inventive design reduce and substantially limit the waste of energy generated during the conventional four step process beginning from intake mode and then followed by compression mode, combustion/expansion mode, and ending with exhaust mode.

Other advantages and meritorious features of this invention will be more fully understood from the following description of the preferred embodiment, the appended claims, and the drawings, a brief description of which follows.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
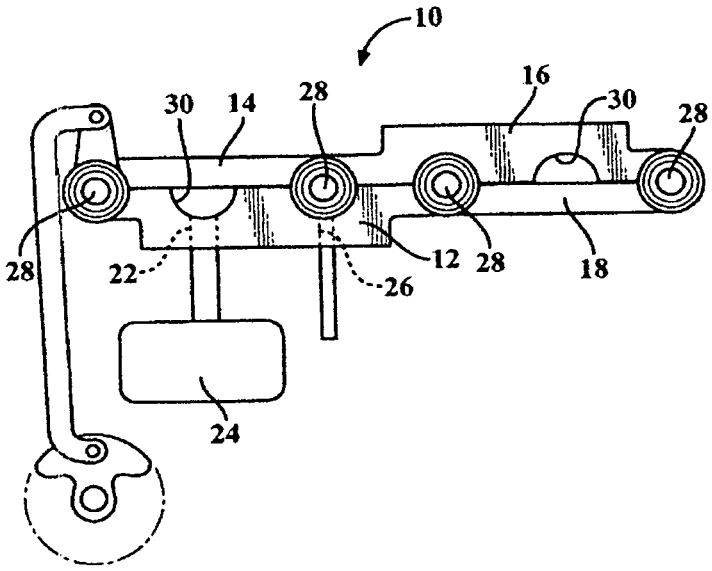
FIGS. 1 through 6 illustrate cross sectional views of an actuator used facilitate a rotational motion of a device.

The concept of the present invention has numerous industrial applications ranging from industrial pumps for circulating fluid to internal combustion engines. The current concept is also used in as actuator in artificial heart as mechanism for circulating human fluids, such as blood through blood vessel system of a human body. If utilized as the actuator for the artificial heart, the present concept may also be used as replacement of damaged or failing heart in animal.

Below are illustrations of several industrial applications without limiting the scope of the present invention. The mechanical and conceptual principals associated with the architecture and functional aspects of the present invention are applicable in numerous other industrial applications not illustrated herewith and without limiting the aspects of the present invention.

Referring to the FIGS. 1 through 7, wherein like numerals indicate like or corresponding parts, a system of the present invention is generally shown at 10.

The concept of the present invention has numerous industrial applications ranging from industrial pumps for circulating fluid to internal combustion engines. The current concept is also used in as actuator in artificial heart as mechanism for circulating human fluids, such as blood through blood vessel system of a human body. If utilized as the actuator for the artificial heart, the present concept may also be used as replacement of damaged or failing heart in animal.

Below are illustrations of several industrial applications without limiting the scope of the present invention. The mechanical and conceptual principals associated with the architecture and functional aspects of the present invention are applicable in numerous other industrial applications not illustrated herewith and without limiting the aspects of the present invention.

One of the applications presents an actuator, generally shown at 10 in FIGS. 1 through 7, for a pump system for moving fluids. Those skilled in the art will appreciate that term "fluid" includes and is not limited to water, gas, oil, and other fluids. The pump system includes a pump device (not shown) having a housing and at least one piston (both not shown) movable in the housing to displace fluids thereby causing flow. An actuator device 10 is connected to the piston for moving the piston within the housing to displace fluids as the actuator device 10 is moved reciprocally between a first position and a second position (shown at A and B in FIG. 2). The actuator device 10 includes a plurality of side portions 12, 14, 16, and 18 pivotably connected to one another to form a vacuum 20 therein and movable relative to one another as the actuator device 10 moves reciprocally between the first position A and the second position B.

One of the side portions 14 is connected to the piston. The actuator device 10 has another of the side portions 12 being permanently secured to a surface as the actuator device 10 is in motion. The third side portion 16 and the side portion 12 extend in parallel and linearly plane relative to one another and are movable from an engaging position (shown in FIG. 1) as the side portions 12 and 16 abut one another to a disengaging position (shown in FIG. 2) as the side portions 12 and 16 move away from one another thereby maintaining the aforementioned parallel and linear plane between the side portions 12 and 16 as the actuator device 10 moves the piston within the actuator device 10.

Figure 2:
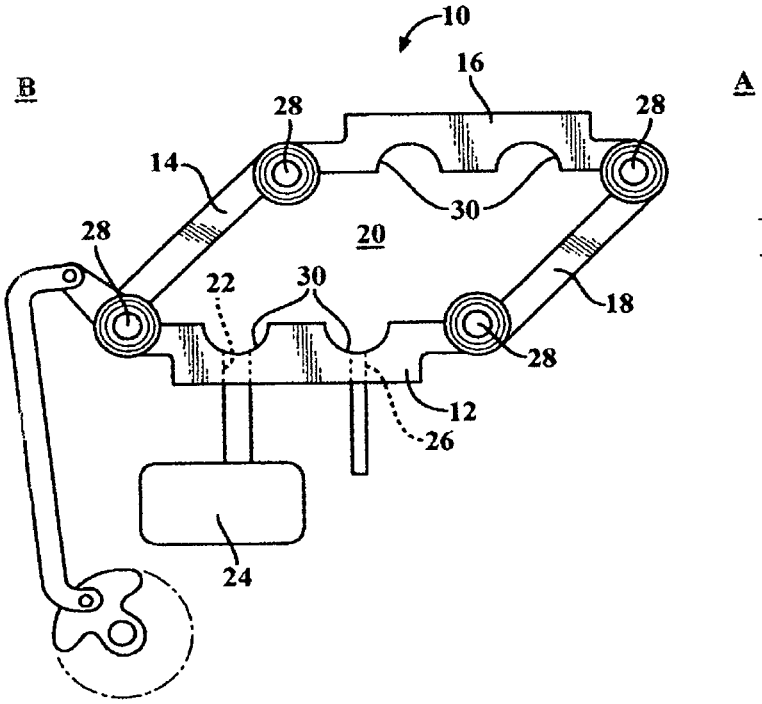
Figure 3:
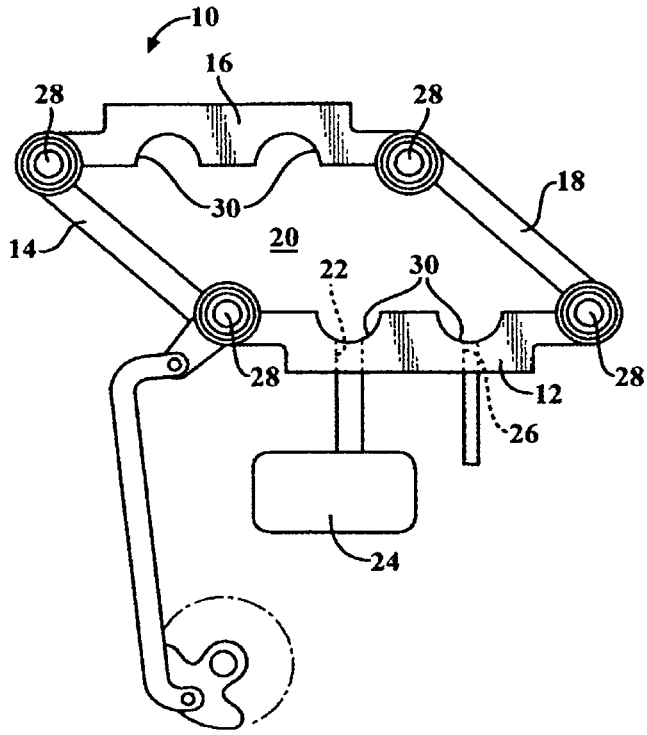
Figure 4:
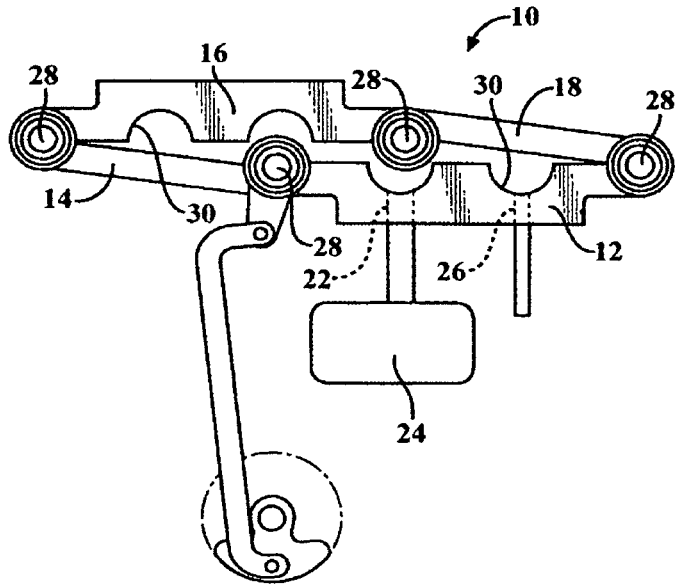
Figure 5:
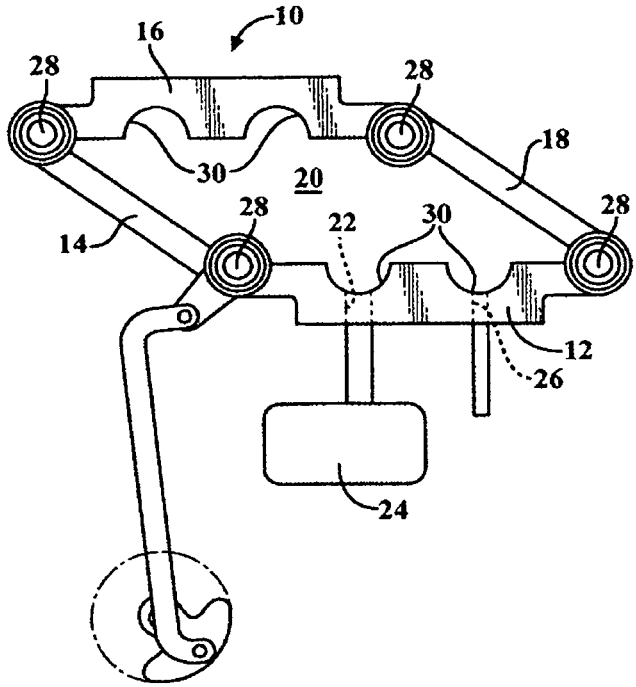
Figure 6:
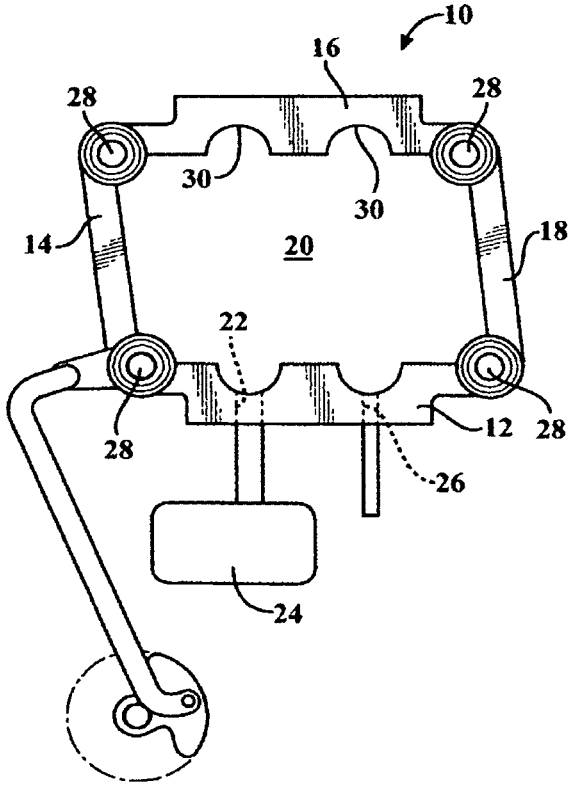

The side portion 12 includes an inlet port 22 for receiving fluid from a fluid supply source 24 to create pressure inside the vacuum 20 thereby expanding the side portions 12 through 18 as the side portions 12, 14, 16, and 18 move from the engaging position as shown in FIG. 1 to the disengaging position as shown in FIG. 2 and an outlet port 26 for releasing fluid as the side portions 12, 14, 16, and 18 collapse to the engaging position thereby moving the piston movable in the housing to displace fluids for causing flow. The side portions 12, 14, 16, and 18 are interconnected to one another by hinges 28 thereby extending between the engaging and disengaging positions. Two of the side portions 12 and 16 include a pair of cavities 30 defined therein to receive the hinges 28 as the side portions 12, 14, 16, and 18 are in the engaging position to completely release fluid beyond the side portions 12, 14, 16, and 18.

A pair of plates (not shown) sandwich the side portions 12, 14, 16, and 18 thereby creating vacuum inside the side portions 12, 14, 16, and 18 as the side portions 12, 14, 16, and 18 move between the engaging and disengaging positions within the plates. The plates and the side portions 12, 14, 16, and 18 may be fabricated from polymeric material, non-polymeric material, and the like, without limiting the scope of the present invention.

Figure 7:
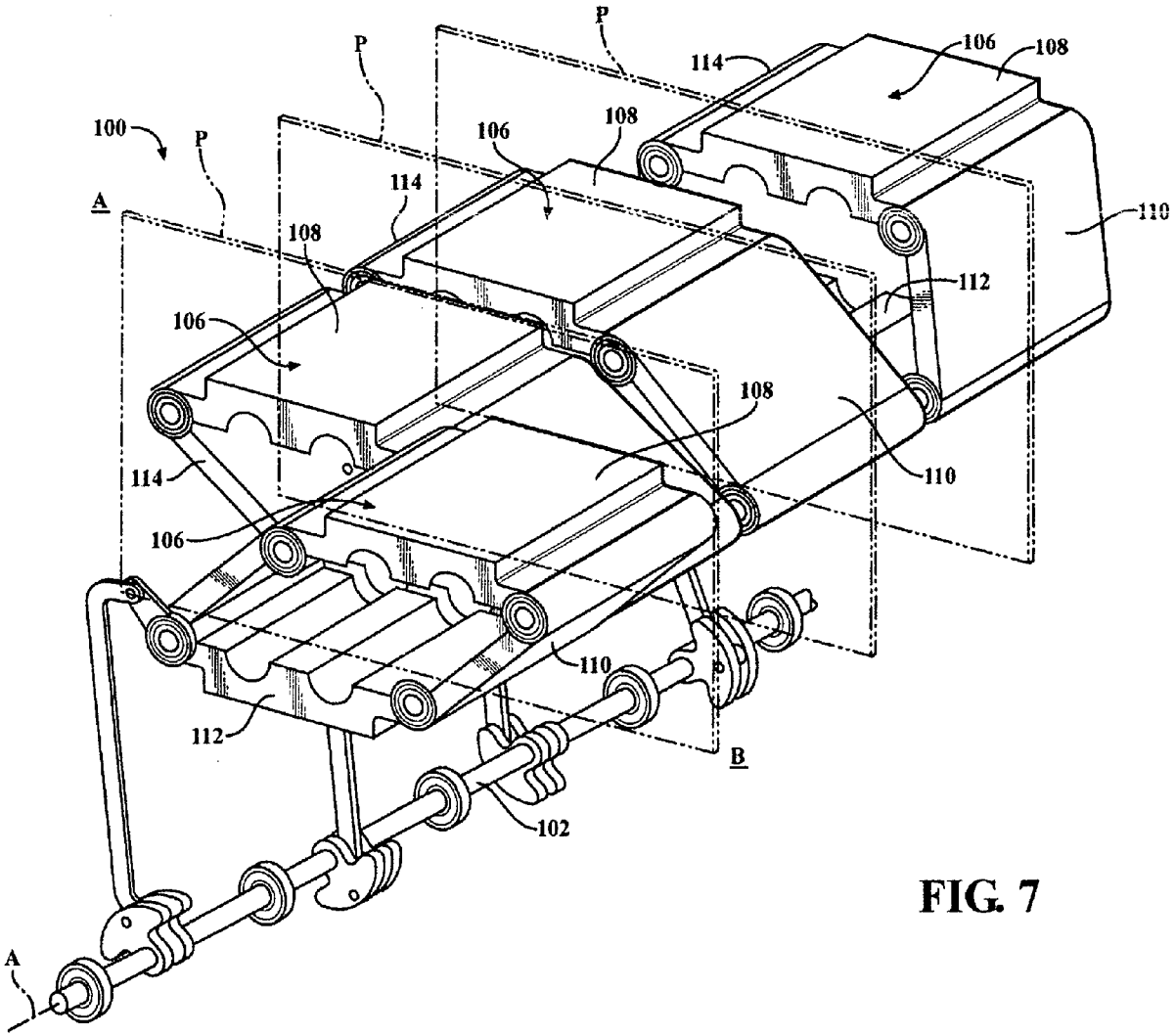
FIG. 7 illustrates a perspective view of another application of the present invention wherein the pistons are sandwiched between side plates thereby creating a hermetically sealed collapsible camera operably connected to a crank shaft for an engine wherein the pistons are reciprocally movable relative to one another to generate a reciprocating motion.
Figure 8:
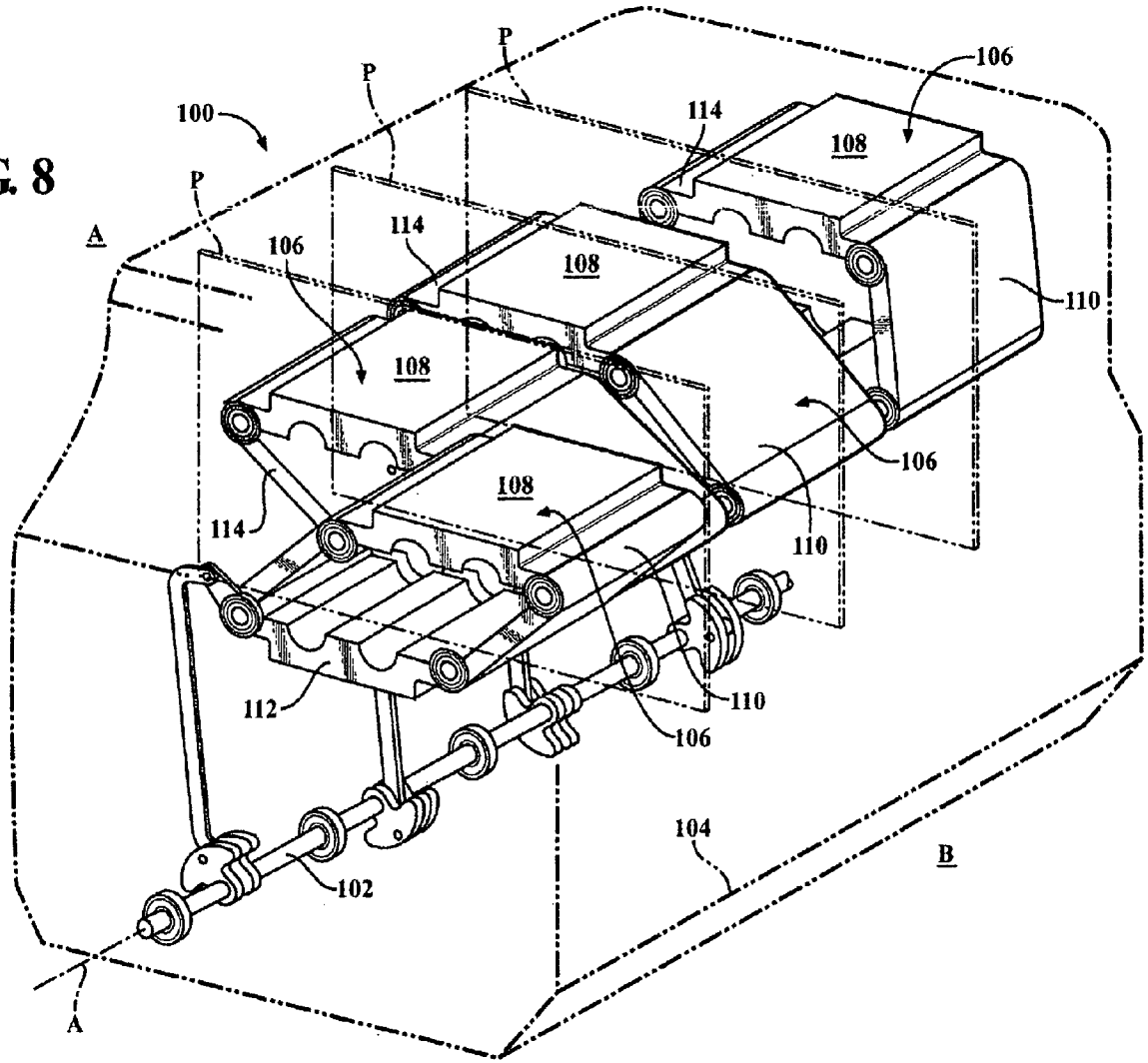
FIG. 8 illustrates another perspective view wherein the pistons, the side plates, and the crankshaft are positioned inside the engine housing illustrated in phantom.

Another application of the present invention is in the internal combustion engine art. The inventive concept of an engine system, as generally shown at 100 in FIGS. 7 and 8, replaces and substantially improves current engine design thereby introducing novel and effective method of utilizing entire amount of energy and translating the energy into rotation force thereby increasing rotational speed of a crankshaft. The engine system 100 of the present invention includes a housing of the engine, shown in phantom at 104 in FIG. 8, a plurality of pistons, generally indicated at 106 in FIGS. 7 and 8, are disposed in the housing 104 and reciprocally movable relative to one another to generate a reciprocating motion. The aforementioned crankshaft 102 is disposed in the housing 104 and presenting a central axis. The crankshaft 102 is connected to the plurality of pistons 106 thereby converting the reciprocating motion of the pistons 106 into a rotational motion of the crankshaft 102. Various other designs of the crankshaft 102 may be used in the application of the present invention without limiting the scope of the present invention.

Alluding to the above, each of the pistons 106 presents a plurality of side portions 108 through 112 connected to one another to form a vacuum therein and movable relative to one another as each of the pistons 106 is moved reciprocally between first (A) and second (B) positions. Each piston 106 is connected to the crankshaft 102. Each piston 106 includes four side portions 108 through 112. One of the side portions 112 is permanently secured to the housing 104 and extends in parallel and linearly plane relative to the side portion 108 and movable from an engaging position as the side portions 108 and 112 abut one another to a disengaging position as the side portions 108 and 112 move away from one another thereby maintaining the parallel and linear plane between the side portions 108 and 112 as the crankshaft 102 rotates about the central axis A.

Alluding to the above, the side portions 112, which is secured to the housing 104, present an inlet port (not shown) for receiving fluid to create pressure inside the vacuum thereby expanding the side portions as the side portions move from the engaging position to the disengaging position. An outlet port is defined adjacent the inlet port. The outlet port is used for releasing fluid as the side portions collapse to the engaging position thereby rotating the crankshaft about the central axis. One of the side portion includes an inlet port for receiving fluid to create pressure inside the vacuum thereby expanding the side portions as the side portions move from the engaging position to the disengaging position and an outlet port for releasing fluid as the side portions collapse to the engaging position thereby moving the piston movable in said housing to displace fluids for causing flow. The side portions are interconnected to one another by hinges thereby extending between the engaging and disengaging positions. Two of the side portions include a pair of cavities defined therein to receive the hinges as the side portions are in the engaging position to completely release fluid beyond the side portions.

A pair of plates sandwich the side portions thereby creating vacuum inside the side portions as the side portions move between the engaging and disengaging positions within the plates. The plates and the side portions may be fabricated from polymeric material, non-polymeric material, and the like.

Still another application of the present invention is a pump system that can be utilized in any household application. The pump is illustrated at 200 is several cross sectional view in FIGS. 9 through 11. The pump system 200 includes a housing, generally indicated at 202 adaptable to receive fluids 204 and release fluids 204 therefrom. One of the examples of such application is pumping of water 204 from a reservoir 206 into a bucket (not shown) to transport the water 204 for further use in the household.

The housing 202 presents a plurality of side portions 208 through 214 connected to one another to form a vacuum therein and movable relative to one another. A lever device, generally shown at 216, is connected to one of the side portions 214. The lever device 216 presents at least one pivoting point 218 to move the lever device 216 having several link elements 224 relative the housing 202 at various directions A and B, as shown in FIGS. 9 and 11, respectively.

Figure 11:
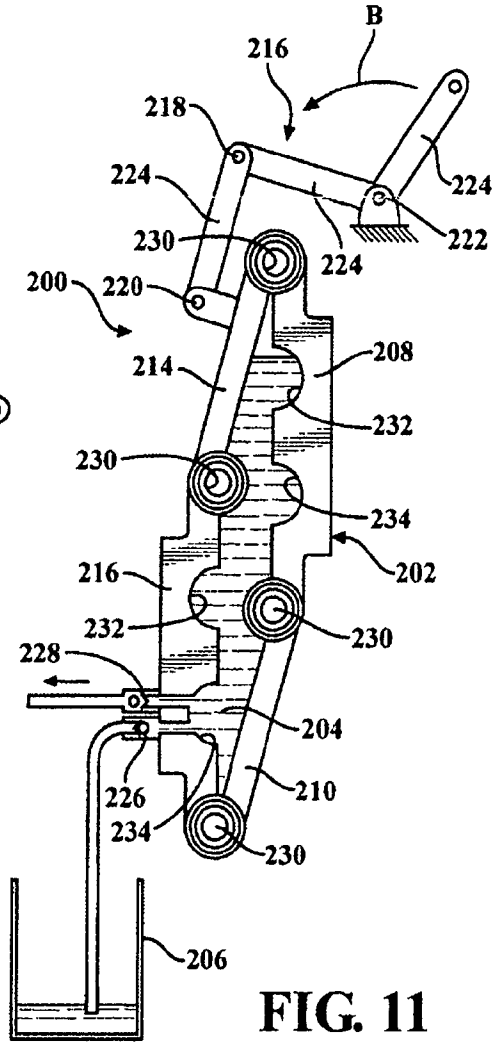
FIG. 11 illustrates still another view of the collapsible camera of FIG. 9 wherein the sides are moved back to the engaging position as the side portions abut one another to transfer fluid from the camera to another fluid collecting source.
Figure 10:
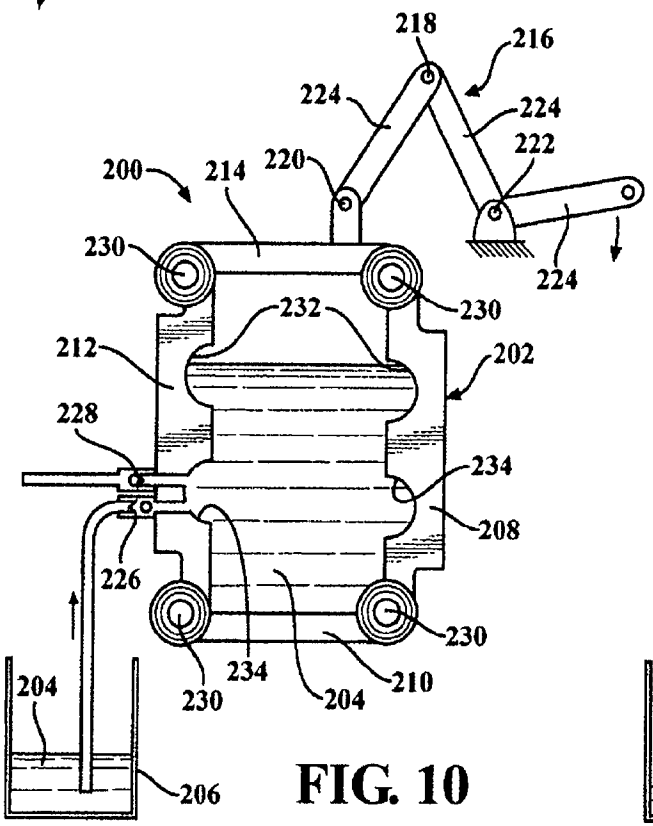
FIG. 10 illustrates another view of the collapsible camera of FIG. 9 expanded to hold fluid wherein the sides portions are illustrated in a disengaging position as the sides move away from one another thereby maintaining the parallel and linear plane therebetween as fluid enters the housing.
Figure 9:
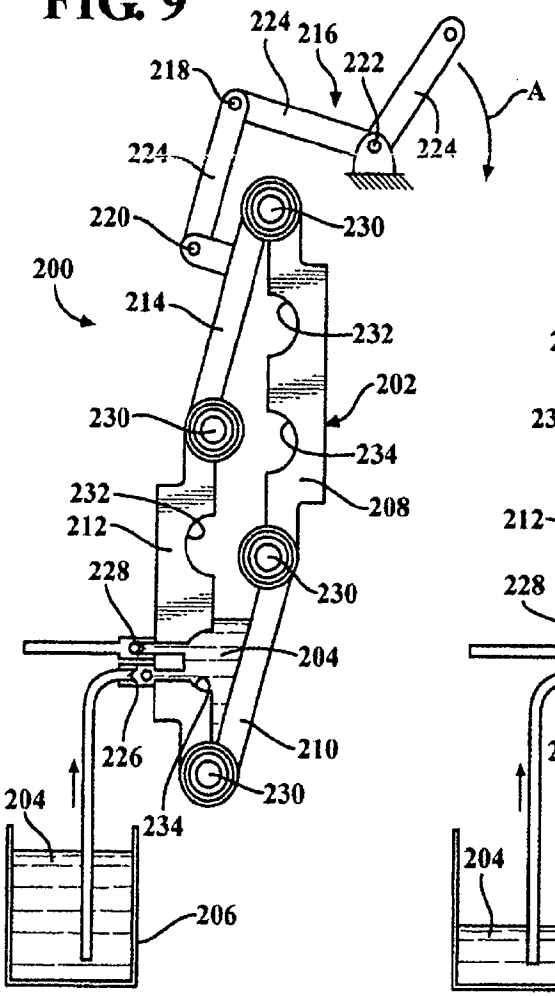
FIG. 9 illustrates a cross sectional view of still another alternative embodiment of the present invention wherein the collapsible camera is used to as a fluid pump to intake fluid through intake port fluidly communicated with a fluid source wherein at least two sides of the camera extend in parallel and linearly plane relative to one another and are illustrated in an engaging position.

The housing 202 has at least two of the side portions 208 and 212 extending in parallel and linearly plane relative to one another and movable from an engaging position, shown in FIG. 9, as the side portions 208 and 212 abut one another to a disengaging position, shown in FIG. 10, as the side portions 208 and 212 move away from one another thereby maintaining the parallel and linear plane between the side portions 208 and 212 as fluid 204 enters the housing 202 from the remote reservoir 206 and then back to the engaging position, shown in FIG. 11, as fluid 204 is moved beyond and out of the housing 202 thereby circulating fluid 204 through the housing 202.

The housing 202 includes four of said side portions 208 through 212 with one of the side portions 212 presenting an inlet port 226 for receiving fluid 204 introduced into the housing 202 and an outlet port 228 for releasing fluid 204 as the side portions 212 and 208 collapse to the engaging position of FIG. 11 thereby circulating fluid 204 through the housing 202. Those skilled in mechanical art will appreciate that various designs of intake and release valve may be used in this inventive application without limiting the scope of the present invention.

The side portions 208 through 212 are interconnected to one another by hinges 230 thereby extending between the engaging and disengaging positions. Two of the side portions 212 and 208 include a pair of cavities 232 and 234 defined therein to receive the hinges 230 as the side portions 212 and 208 are in the engaging position to completely release fluid 204 beyond the housing 202.

A pair of plates (not shown) sandwich the side portions 208 through 212 therebetween to create vacuum inside the side portions 208 through 212 as the side portions 208 through 212 move between the engaging and disengaging positions within the plates. The plates and the side portions may be fabricated from polymeric material, non-polymeric material, and the like. The plates and the side portions 208 through 212 are lubricated to eliminate any wear and tear and any voids defined therebetween to ensure air-tight vacuum environment within the side portions 208 through 212. Those skilled in the art will appreciate that the length and width of the side portions 208 through 212 is not intended to limit the scope of the present invention.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An engine system comprising;

a housing, a plurality of pistons disposed in said housing and reciprocally movable relative to one another to generate a reciprocating motion, a crankshaft disposed in said housing presenting a central axis, said crankshaft connected to said plurality of pistons thereby converting the reciprocating motion of said plurality of pistons into a rotational motion of said crankshaft;

a plurality of plates having a planar configuration and being sandwiched by said side portions of each of said pistons, said side portions extending perpendicularly and outwardly from each of said plates thereby creating said vacuum inside said side portions; and each of said pistons presenting a plurality of side portions connected to one another to form a vacuum therein and movable relative to one another as each of said pistons is moved reciprocally between engaging and disengaging positions with one of said side portions connected to said crankshaft and extending in parallel and linearly plane and movable from said engaging position as said side portions abut one another to said disengaging position as said portions move away from one another thereby maintaining said parallel and linear plane between said side portions as said crankshaft rotates about said central axis.

2. An engine system as set forth in claim 1 wherein said piston includes four of said side portions with one of said side portions that being secured to said housing for receiving fluid to create pressure inside said vacuum thereby expanding said side portions as said side portions move from said engaging position to said disengaging position and releasing fluid as said side portions collapse to said engaging position thereby rotating said crankshaft about said central axis.

3. An engine system as set forth in claim 2 wherein said side portions are interconnected to one another by hinges thereby extending between said engaging and disengaging positions.

4. An engine system as set forth in claim 3 wherein at least two of said side portions include a pair of cavities defined therein to receive said hinges as said side portions are in said engaging position to completely release fluid beyond said side portions.

5. An engine system as set forth in claim 4 including a source of fluid supply connected to said inlet port to inject fluid into said pistons.

6. An engine system as set forth in claim 1 wherein said plates and said side portions are fabricated from polymeric material.

7. An engine system as set forth in claim 1 wherein said plates and said side portions are fabricated from non-polymeric material.

8. An engine system as set forth in claim 2 wherein said side portions are equal in width and length.

9. An engine system as set forth in claim 2 wherein two of said side portions oppositely spaced from one another have first length being different than length of the other two of said sick portions.

* * * * *